US011206483B2

(12) United States Patent
Hou

(10) Patent No.: US 11,206,483 B2
(45) Date of Patent: Dec. 21, 2021

(54) AUDIO SIGNAL PROCESSING METHOD AND DEVICE, TERMINAL AND STORAGE MEDIUM

(71) Applicant: Beijing Xiaomi Intelligent Technology Co., Ltd., Beijing (CN)

(72) Inventor: Haining Hou, Beijing (CN)

(73) Assignee: Beijing Xiaomi Intelligent Technology Co., Ltd., Beijing (CN)

( * ) Notice: Subject to any disclaimer, the term of this patent is extended or adjusted under 35 U.S.C. 154(b) by 0 days.

(21) Appl. No.: 16/862,295

(22) Filed: Apr. 29, 2020

(65) Prior Publication Data

US 2021/0185437 A1 Jun. 17, 2021

(30) Foreign Application Priority Data

Dec. 17, 2019 (CN) ..... 201911302532.X

(51) Int. Cl.

*H04R 3/00* (2006.01)
*G10L 25/18* (2013.01)
*H04R 1/40* (2006.01)

(52) U.S. Cl.

CPC ..... *H04R 3/005* (2013.01); *G10L 25/18* (2013.01); *H04R 1/406* (2013.01)

(58) Field of Classification Search

CPC ..... H04R 3/005; H04R 1/406; G10L 25/18
(Continued)

(56) References Cited

U.S. PATENT DOCUMENTS

2013/0051566 A1* 2/2013 Pontoppidan ..... H04R 25/353 381/23.1
2018/0254053 A1* 9/2018 Shi ..... H03H 21/0043
(Continued)

FOREIGN PATENT DOCUMENTS

CN 109074811 12/2018
EP 3440670 2/2019
(Continued)

OTHER PUBLICATIONS

Extended European Search Report dated Oct. 22, 2020 in European Patent Application No. 20171553.9, 7 pages.
(Continued)

*Primary Examiner* — Katherine A Faley
(74) *Attorney, Agent, or Firm* — Oblon, McClelland, Maier & Neustadt, L.L.P.

(57) ABSTRACT

Provided are an audio signal processing method and device. The method can include acquiring audio signals from at least two sound sources through at least two microphones to obtain multiple frames of original noise signals of the at least two microphones in a time domain, and, for each frame in the time domain, acquiring respective frequency-domain estimated signals of the at least two sound sources according to the respective original noise signals. The method can further include, for each sound source, dividing the frequency-domain estimated signal into frequency-domain estimated components which each corresponds to a frequency-domain sub-band and includes multiple frequency point data in a frequency domain, determining a weighting coefficient of each frequency point in the frequency-domain sub-band, and updating a separation matrix of each frequency point according to the weighting coefficient and obtaining the audio signals based on the updated separation matrices and the original noise signals.

18 Claims, 5 Drawing Sheets

(58) Field of Classification Search
USPC ..... 381/92
See application file for complete search history.

(56) References Cited

U.S. PATENT DOCUMENTS

| | | | |
|---|---|---|---|
| 2019/0122674 | A1 | 4/2019 | Wang et al. |
| 2019/0392848 | A1 | 12/2019 | Wang et al. |
| 2020/0167602 | A1 | 5/2020 | Betts |

FOREIGN PATENT DOCUMENTS

| | | |
|---|---|---|
| JP | 2011-215317 | 10/2011 |
| JP | 2019-514056 | 5/2019 |
| KR | 10-2009-0123921 | 12/2009 |
| WO | WO 2019/016494 A1 | 1/2019 |

OTHER PUBLICATIONS

Francesco Nesta et al., "Convolutive Underdetermined Sources Separation through Weighted Interleaved ICA and Spatio-temporal Source Correlation", 2012, LNCS, 7191, pp. 222-230.
Shoko, Araki et al., "Fundamental limitation of frequency domain blind source seperation for convolutive mixtures of speech", and IEE Trans.on Speech and audio proocessing, vol. 11, No. 2, Mar. 2003.
Hiroshi Saruwatari et al., "Blind Source Separation Combining Independent Component Analysis and Beamforming", EURASIP Journal on Applied Signal Processing, p. 1135-1146, 2003.
Ibrahim Missaoui et al."Blind speech separation based on undecimated wavelet packet-perceptual filterbanks and independent component analysis",IJCSI, vol. 8, the No. 1, and the May 2011.
First Office Action of the Japanese application No. 2020-084953, dated Jul. 28, 2021, with concise English translation.
First Office Action of the Korean application No. 10-2020-0059427, with concise English translation, dated Aug. 30, 2021.

* cited by examiner

AUDIO SIGNAL PROCESSING METHOD AND DEVICE, TERMINAL AND STORAGE MEDIUM

CROSS-REFERENCE TO RELATED APPLICATION

This application is based upon and claims priority to Chinese Patent Application No. CN201911302532.X filed on Dec. 17, 2019, the entire contents of which are incorporated herein by reference.

TECHNICAL FIELD

The present disclosure generally relates to the technical field of communications, and more particularly, to a method and device for processing an audio signal, a terminal, and a storage medium.

BACKGROUND

An intelligent product generally use a microphone array for pickup. A microphone beamforming technology is usually adopted to improve processing quality of voice signals to increase a voice recognition rate in a real environment. However, a multi-microphone beamforming technology is sensitive to a microphone position error, resulting in relatively great impact on performance. In addition, the increased number of microphones may also increase product cost.

Therefore, more and more intelligent products are provided with only two microphones. A blind source separation technology completely different from the multi-microphone beamforming technology is usually adopted for the two microphones for voice enhancement. However, there has been no technique for how to achieve higher voice quality of a signal separated based on the blind source separation technology.

SUMMARY

According to a first aspect of the disclosure, a method for processing an audio signal is provided. The method can include that audio signals sent by at least two sound sources respectively are acquired through at least two microphones to obtain respective multiple frames of original noise signals of the at least two microphones in a time domain. For each frame in the time domain, respective frequency-domain estimated signals of the at least two sound sources are acquired according to the respective original noise signals of the at least two microphones. For each of the at least two sound sources, the frequency-domain estimated signal is divided into multiple frequency-domain estimated components in a frequency domain, each frequency-domain estimated component corresponding to one frequency-domain sub-band and including multiple frequency point data. Further, in each frequency-domain sub-band, a weighting coefficient of each frequency point in the frequency-domain sub-band is determined, and a separation matrix of each frequency point is updated according to the weighting coefficient. Finally, the audio signals sent by the at least two sound sources respectively are obtained based on the updated separation matrices and the original noise signals.

According to a second aspect of the disclosure, a terminal can be provided. The terminal may include a processor and a memory configured to store instructions executable by the processor. The processor may be configured to acquire audio signals from at least two sound sources respectively through at least two microphones to obtain respective multiple frames of original noise signals of the at least two microphones in a time domain, and, for each frame in the time domain, acquire respective frequency-domain estimated signals of the at least two sound sources according to the respective original noise signals of the at least two microphones. Further, the processor can, for each of the at least two sound sources, divide the frequency-domain estimated signal into multiple frequency-domain estimated components in a frequency domain, each frequency-domain estimated component corresponding to one frequency-domain sub-band and including multiple frequency point data and, in each frequency-domain sub-band, determine a weighting coefficient of each frequency point in the frequency-domain sub-band and update a separation matrix of each frequency point according to the weighting coefficient. Finally, the processor can obtain the audio signals sent by the at least two sound sources respectively based on the updated separation matrices and the original noise signals.

According to a third aspect of the disclosure, a computer-readable storage medium is provided, which may have stored an executable program. The executable program being executable by a processor to implement the method for processing an audio signal according to any embodiment of the present disclosure.

The technical solutions provided by embodiments may have beneficial effects. For example, multiple frames of original noise signals of at least two microphones in a time domain may be acquired, for each frame in the time domain, respective frequency-domain estimated signals of the at least two sound sources may be obtained by conversion according to the respective original noise signals of the at least two microphones, and for each of the at least two sound sources, the frequency-domain estimated signal may be divided into at least two frequency-domain estimated components in different frequency-domain sub-bands, thereby obtaining updated separation matrices based on weighting coefficients of the frequency-domain estimated components and the frequency-domain estimated signals. In such a manner, according to the embodiments of the present disclosure, the updated separation matrices may be obtained based on the weighting coefficients of the frequency-domain estimated components in different frequency-domain sub-bands, which, compared with obtaining the separation matrices based on that all frequency-domain estimated signals of a whole band have the same dependence in related arts, may achieve higher separation performance. Therefore, separation performance may be improved by obtaining audio signals from at least two sound sources based on the original noise signals and the separation matrices obtained according to the embodiments of the present disclosure, and some easy-to-damage voice signals of the frequency-domain estimated signals may be recovered to further improve voice separation quality.

It is to be understood that the above general descriptions and detailed descriptions below are only exemplary and explanatory and not intended to limit the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

The terminologies used in the disclosure are for the purpose of describing the specific embodiments only and are not intended to limit the disclosure. The singular forms "one", "the" and "this" used in the disclosure and the appended claims are intended to include the plural forms, unless the context clearly indicates other meanings. It should also be understood that the term "and/or" as used herein refers to and includes any or all possible combinations of one or more associated listed items.

It should be understood that, although the terminologies "first", "second", "third" and so on may be used in the disclosure to describe various information, such information shall not be limited to these terms. These terms are used only to distinguish information of the same type from each other. For example, without departing from the scope of the disclosure, first information may also be referred to as second information. Similarly, second information may also be referred to as first information. Depending on the context, the word "if" as used herein may be explained as "when . . . ", "while" or "in response to determining."

Figure 1:
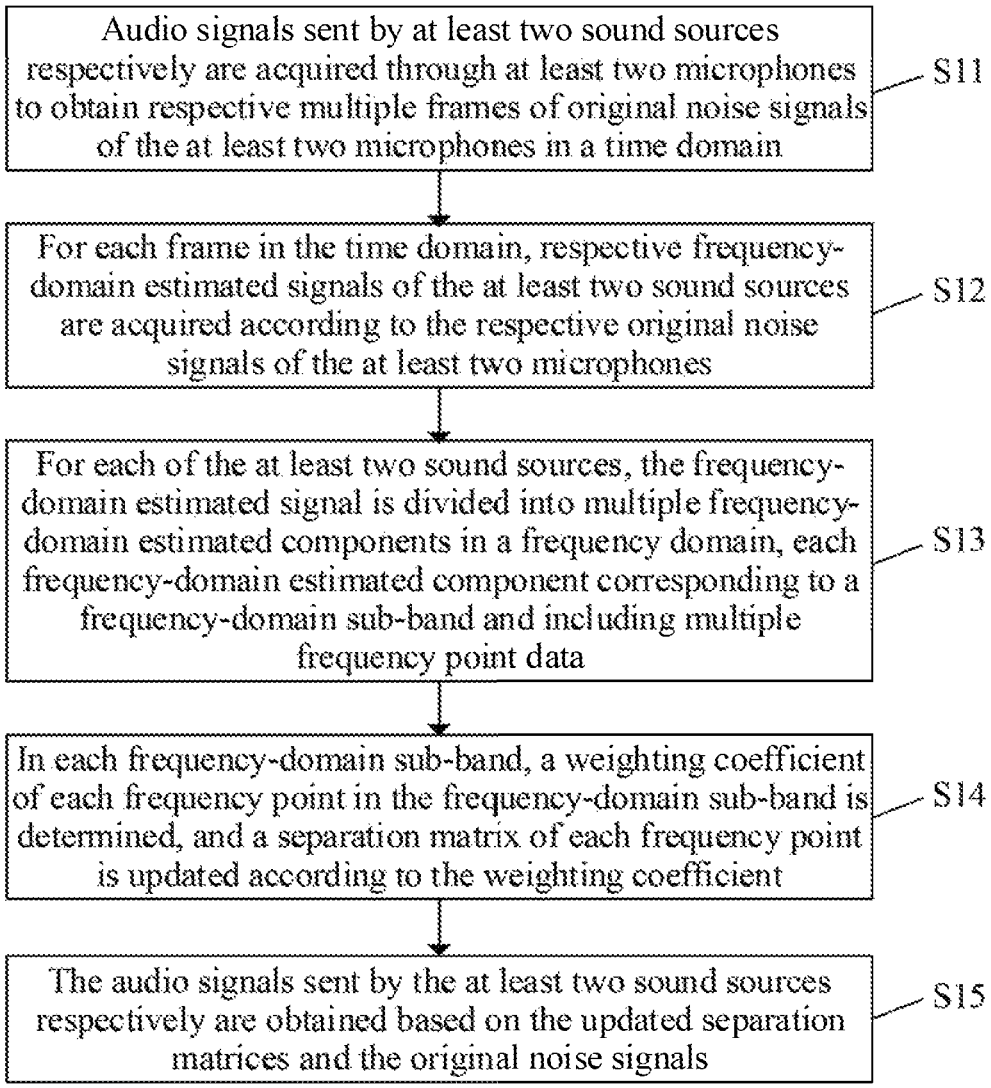
FIG. 1 is a flowchart showing a method for processing an audio signal according to an exemplary embodiment.

FIG. 1 is a flowchart showing a method for processing an audio signal according to an exemplary embodiment. As shown in FIG. 1, the method can include the following operations.

In S11, audio signals sent by at least two sound sources respectively are acquired through at least two microphones to obtain respective multiple frames of original noise signals of the at least two microphones in a time domain.

In S12, for each frame in the time domain, respective frequency-domain estimated signals of the at least two sound sources are acquired according to the respective original noise signals of the at least two microphones.

In S13, for each of the at least two sound sources, the frequency-domain estimated signal is divided into multiple frequency-domain estimated components in a frequency domain, each frequency-domain estimated component corresponding to one frequency-domain sub-band and including multiple frequency point data.

In S14, in each frequency-domain sub-band, a weighting coefficient of each frequency point in the frequency-domain sub-band is determined, and a separation matrix of each frequency point is updated according to the weighting coefficient.

In S15, the audio signals sent by the at least two sound sources respectively are obtained based on the updated separation matrices and the original noise signals.

The method in the embodiments may be applied to a terminal. Herein, the terminal may be any electronic device integrated with two or more than two microphones. For example, the terminal may be a vehicle terminal, a computer or a server. In an embodiment, the terminal may also be an electronic device connected with a predetermined device integrated with two or more than two microphones, and the electronic device may receive an audio signal acquired by the predetermined device based on this connection and send the processed audio signal to the predetermined device based on the connection. For example, the predetermined device is a speaker.

In a practical application, the terminal may include at least two microphones, and the at least two microphones may simultaneously detect the audio signals sent by the at least two sound sources respectively to obtain the respective original noise signals of the at least two microphones. Herein, it can be understood that the at least two microphones may synchronously detect the audio signals sent by the two sound sources.

According to the method for processing an audio signal of the embodiments, audio signals of audio frames in a predetermined time may be started to be separated after original noise signals of the audio frames in the predetermined time are completely acquired.

In the embodiments, there may be two or more than two microphones, and there may be two or more than two sound sources.

The original noise signal may be a mixed signal including sounds produced by the at least two sound sources. For example, there are two microphones, i.e., microphone 1 and microphone 2 respectively, and there are two sound sources, i.e., sound source 1 and sound source 2 respectively. In such a case, the original noise signal of the microphone 1 may include the audio signals of the sound source 1 and the sound source 2, and the original noise signal of the microphone 2 may also include the audio signals of both the sound source 1 and the sound source 2.

For example, there are three microphones, i.e., microphone 1, microphone 2, and microphone 3 respectively, and there are three sound sources, i.e., sound source 1, sound source 2, and sound source 3 respectively. In such a case, the original noise signal of the microphone 1 may include the audio signals of the sound source 1, the sound source 2, and the sound source 3; and the original noise signals of the microphone 2 and the microphone 3 may also include the audio signals of all the sound source 1, the sound source 2, and the sound source 3.

It can be understood that, if a signal of the sound produced by a sound source is an audio signal in a microphone, then signals of other sound sources in the microphone may be a noise signal. According to the embodiments of the present disclosure, the sounds produced by the at least two sound sources may be required to be recovered from the at least two microphones.

It can be understood that the number of the sound sources is usually the same as the number of the microphones. In some embodiments, if the number of the microphones is smaller than the number of the sound sources, a dimension of the number of the sound sources may be reduced to a dimension equal to the number of the microphones.

In the embodiments, the frequency-domain estimated signal may be divided into at least two frequency-domain estimated components in at least two frequency-domain sub-bands. The volumes of the frequency point data in the frequency-domain estimated components in any two frequency-domain sub-bands may be the same or different.

Herein, the multiple frames of original noise signals may refer to original noise signals of multiple audio frames. In an embodiment, an audio frame may be an audio band with a preset time length.

For example, there may be totally 100 frequency-domain estimated signals, and the frequency-domain estimated signals may be divided into frequency-domain estimated components of three frequency-domain sub-bands. The frequency-domain estimated components of the first frequency-domain sub-band, the second frequency-domain sub-band and the third frequency-domain sub-band may include 25, 35, and 40 frequency point data respectively. For another example, there may be totally 100 frequency-domain estimated signals, and the frequency-domain estimated signals may be divided into frequency-domain estimated components of four frequency-domain sub-bands. The frequency-domain estimated components of the four frequency-domain sub-bands may include 25 frequency point data respectively.

In the embodiments, multiple frames of original noise signals of at least two microphones in the time domain may be acquired. For each frame in a time domain, respective frequency-domain estimated signals of at least two sound sources may be obtained by conversion according to the respective original noise signals of the at least two microphones; and for each of the at least two sound sources, the frequency-domain estimated signal may be divided into at least two frequency-domain estimated components in different frequency-domain sub-bands, thereby obtaining the updated separation matrices based on the weighting coefficients of the frequency-domain estimated components and the frequency-domain estimated signals. In such a manner, the updated separation matrices may be obtained based on the weighting coefficients of the frequency-domain estimated components in different frequency-domain sub-bands, which may achieve higher separation performance, compared with obtaining the separation matrices based on that all frequency-domain estimated signals of a whole band have the same dependence in related arts. Therefore, the separation performance may be improved by obtaining audio signals from the at least two sound sources based on the original noise signals and the separation matrices obtained according to the embodiments of the present disclosure, and some easy-to-damage voice signals of the frequency-domain estimated signals may be recovered to further improve voice separation quality.

Compared with the situation that signals of sound sources are separated using a multi-microphone beamforming technology, the method for processing an audio signal provided in the embodiments of the present disclosure has the advantage that there is no need to consider where these microphones are arranged, so that the audio signals of the sounds produced by the sound sources may be separated more accurately.

In addition, if the method for processing an audio signal is applied to a terminal device with two microphones, compared with the related arts that voice quality is improved by a beamforming technology based on at least more than three microphones, the method also has the advantages that the number of the microphones is greatly reduced, and hardware cost of the terminal is reduced.

In some embodiments, S14 may include that, for each sound source, gradient iteration is performed on the weighting coefficient of the nth frequency-domain estimated component, the frequency-domain estimated signal and an (x−1) th alternative matrix to obtain an xth alternative matrix, a first alternative matrix being a known identity matrix, x being a positive integer greater than or equal to 2, n being a positive integer smaller than N and N being the number of the frequency-domain sub-bands. Further, when the xth alternative matrix meets an iteration stopping condition, the updated separation matrix of each frequency point in the nth frequency-domain estimated component is obtained based on the xth alternative matrix.

In the embodiments, gradient iteration may be performed on the alternative matrix by use of a natural gradient algorithm. The alternative matrix may get increasingly approximate to the required separation matrix every time gradient iteration is performed once.

Herein, meeting the iteration stopping condition may refer to that the xth alternative matrix and the (x−1) alternative matrix meet a convergence condition. In an embodiment, the situation that the xth alternative matrix and the (x−1)th alternative matrix meet the convergence condition may refer to that a product of the xth alternative matrix and the (x−1)th alternative matrix is in a predetermined numerical range. For example, the predetermined numerical range is (0.9, 1.1).

In an embodiment, gradient iteration may be performed on the weighting coefficient of the nth frequency-domain estimated component, the frequency-domain estimated signal and the (x−1)th alternative matrix to obtain the xth alternative matrix through the following specific formula:

$$W_x(k) = W_{x-1}(k) + \eta g\left\{I - \frac{1}{M}\sum_{m=1}^{M}[\phi_n(k,m)gY(k,m)]Y^H(k,m)\right\}W_{x-1}(k),$$

where $W_x(k)$ is the xth alternative matrix, $W_{x-1}(k)$ is the (x−1)th alternative matrix, $\eta$ is an updating step length, $\eta$ is a real number in [0.005, 0.1], M is the number of frames of audio frames acquired by the microphone, $\phi_n(k,m)$ is the weighting coefficient of the nth frequency-domain estimated component, k is the frequency point of a band, Y(k,m) is the frequency-domain estimated signal at the frequency point k, and $Y^H(k,m)$ is a conjugate transpose of Y(k,m).

In a practical application scenario, meeting the iteration stopping condition in the formula may be: $|1-\mathrm{tr}\{\mathrm{abs}(W_0(k)W^H(k))\}/N|\leq\xi$, where $\xi$ is a number larger than or equal to 0 and smaller than $(1/10^5)$. In an embodiment, $\xi$ is 0.0000001.

Accordingly, the frequency point corresponding to each frequency-domain estimated component may be continuously updated based on the weighting coefficient of the frequency-domain estimated component of each frequency-domain sub-band and the frequency-domain estimated signal of each frame, and the like, to ensure higher separation performance of the updated separation matrix of each frequency point in the frequency-domain estimated component, so that accuracy of the separated audio signal may further be improved.

In some embodiments, gradient iteration may be performed according to a sequence from high to low frequencies of the frequency-domain sub-bands where the frequency-domain estimated signals are located.

Accordingly, the separation matrices of the frequency-domain estimated signals may be sequentially acquired based on the frequencies corresponding to the frequency-domain sub-bands, so that the condition that the separation matrices corresponding to some frequency points are omitted may be greatly reduced, loss of the audio signal of each sound source at each frequency point may be reduced, and quality of the acquired audio signals of the sound sources may be improved.

In addition, the gradient iteration, which is performed according to the sequence from the high to low frequencies of the frequency-domain sub-bands where the frequency point data is located, may further simplify calculation. For example, if the frequency of the first frequency-domain sub-band is higher than the frequency of the second frequency-domain sub-band and the frequencies of the first frequency-domain sub-band and the second frequency-domain sub-band partially overlap, after the separation matrix of the frequency-domain estimated signal in the first frequency-domain sub-band is acquired, the separation matrix of the frequency point corresponding to a part, overlapping the frequency of the first frequency-domain sub-band, in the second frequency-domain sub-band may be not required to be calculated, so that the calculation can be simplified.

It can be understood that, in the embodiments of the present disclosure, the sequence from the high to low frequencies of the frequency-domain sub-bands is considered for calculation reliability during practical calculation. In other embodiments, a sequence from the low to high frequencies of frequency-domain sub-bands may also be considered. There are no limits made herein.

In an embodiment, the operation that the multiple frames of original noise signals of the at least two microphones in the time domain are obtained may include that each frame of original noise signal of the at least two microphones in the time domain is acquired.

In some embodiments, the operation that the original noise signal is converted into the frequency-domain estimated signal may include that: the original noise signal in the time domain is converted into an original noise signal in the frequency domain, and the original noise signal in the frequency domain is converted into the frequency-domain estimated signal.

Herein, frequency-domain transform may be performed on the time-domain signal based on Fast Fourier Transform (FFT). Or, frequency-domain transform may be performed on the time-domain signal based on Short-Time Fourier Transform (STFT). Or, frequency-domain transform may be performed on the time-domain signal based on other Fourier transform.

For example, if the mth frame of time-domain signal of the yth microphone is $x_y^m(m')$, then the mth frame of time-domain signal may be converted into a frequency-domain signal, and the mth frame of original noise signal may be determined to be: $X_y(k,m)=STFT(x_y^m(m'))$, where k is the frequency point, k=1, L, K, m is the number of discrete time points of the kth frame of time-domain signal, and m'=1, L, Nfft. Therefore, according to the embodiments, each frame of original noise signal in the frequency domain may be obtained by conversion from the time domain to the frequency domain. Each frame of original noise signal may also be obtained based on other Fourier transform formulae. There are no limits made herein.

In an embodiment, the operation that the original noise signal in the frequency domain is converted into the frequency-domain estimated signal may include that: the original noise signal in the frequency domain is converted into the frequency-domain estimated signal based on a known identity matrix.

In another embodiment, the operation that the original noise signal in the frequency domain is converted into the frequency-domain estimated signal may include that: the original noise signal in the frequency domain is converted into the frequency-domain estimated signal based on an alternative matrix. Herein, the alternative matrix may be the first to (x−1)th alternative matrices in the abovementioned embodiments.

For example, the frequency point data of the frequency point k in the mth frame is acquired to be: Y(k,m)=W(k)X(k,m), where X(k,m) is the mth frame of original noise signal in the frequency domain, and W(k) may be the first to (x−1)th alternative matrices in the abovementioned embodiments. For example, W(k) is a known identity matrix or an alternative matrix obtained by (x−1)th iteration.

In the embodiments, the original noise signal in the time domain may be converted into the original noise signal in the frequency domain, and the frequency-domain estimated signal that is pre-estimated may be obtained based on the separation matrix that is not updated or the identity matrix. Therefore, a basis may be provided for subsequently separating the audio signal of each sound source based on the frequency-domain estimated signal and the separation matrix.

In some embodiments, the method may further include that the weighting coefficient of the nth frequency-domain estimated component is obtained based on a quadratic sum of the frequency point data corresponding to each frequency point in the nth frequency-domain estimated component.

In an embodiment, the operation that the weighting coefficient of the nth frequency-domain estimated component is obtained based on the quadratic sum of the frequency point data corresponding to each frequency point in the nth frequency-domain estimated component may include that a first numerical value is determined based on the quadratic sum of the frequency point data in the nth frequency-domain estimated component, and the weighting coefficient of the nth frequency-domain estimated component is determined based on a square root of the first numerical value.

In an embodiment, the operation that the weighting coefficient of the nth frequency-domain estimated component is determined based on the square root of the first numerical value may include that the weighting coefficient of the nth frequency-domain estimated component is determined based on a reciprocal of the square root of the first numerical value.

In the embodiments, the weighting coefficient of each frequency-domain sub-band may be determined based on the frequency-domain estimated signal corresponding to each frequency point in the frequency-domain estimated components of the frequency-domain sub-band. In such a manner, compared with the related arts, for the weighting coefficient, a priori probability density of all the frequency points of the whole band is not needed to be considered, and only a priori probability density of the frequency points corresponding to the frequency-domain sub-band is needed to be considered. Accordingly, calculation may be simplified on one hand, and on the other hand, the frequency points that are relatively far away from each other in the whole band are not needed to be considered, so that a priori probability density of the frequency points that are relatively far away from each other in the frequency-domain sub-band is not needed to be considered for the separation matrix determined based on the weighting coefficient. That is, dependence of the frequency points that are relatively far away from each other in the band is not needed to be considered, so that the determined separation matrix has higher separation performance, which is favorable for subsequently obtaining an audio signal with higher quality based on the separation matrix.

In some embodiments, the frequencies of any two adjacent frequency-domain sub-bands may partially overlap in the frequency domain. For example, there may be totally 100 frequency-domain estimated signals, including frequency point data corresponding to frequency points $k_1$, $k_2$, $k_3$, . . . , $k_l$ and $k_{100}$, l being a positive integer greater than 2 and smaller than or equal to 100. The band may be divided into four frequency-domain sub-bands; the frequency-domain estimated components of the four frequency-domain sub-bands, which sequentially are a first frequency-domain sub-band, a second frequency-domain sub-band, a third frequency-domain sub-band and a fourth frequency-domain sub-band, may include the frequency point data corresponding to $k_1$ to $k_{30}$, the frequency point data corresponding to $k_{25}$ to $k_{55}$, the frequency point data corresponding to $k_{50}$ to $k_{80}$ and the frequency point data corresponding to $k_{75}$ to $k_{100}$ respectively.

Therefore, the first frequency-domain sub-band and the second frequency-domain sub-band may have six overlapping frequency points $k_{25}$ to $k_{30}$ in the frequency domain, and the first frequency-domain sub-band and the second frequency-domain sub-band may include the same frequency point data corresponding to $k_{25}$ to $k_{30}$; the second frequency-domain sub-band and the third frequency-domain sub-hand may have six overlapping frequency points $k_{50}$ to $k_{55}$ in the frequency domain, and the second frequency-domain sub-band and the third frequency-domain sub-band may include the same frequency point data corresponding to $k_{50}$ to $k_{55}$; and the third frequency-domain sub-band and the fourth frequency-domain sub-band may have six overlapping frequency points $k_{75}$ to $k_{80}$ in the frequency domain, and the third frequency-domain sub-band and the fourth frequency-domain sub-band may include the same frequency point data corresponding to $k_{75}$ to $k_{80}$.

In the embodiments, the frequencies of any two adjacent frequency-domain sub-bands may partially overlap in the frequency domain, so that the dependence of data of each frequency point in the adjacent frequency-domain sub-bands may be strengthened based on a principle that the dependence of the frequency points that are relatively close to each other in the band is stronger, and inaccurate calculation caused by omission of some frequency points for calculation of the weighting coefficient of the frequency-domain estimated component of each frequency-domain sub-band may be greatly reduced to further improve accuracy of the weighting coefficient.

In addition, in the embodiments, if the separation matrix of data of each frequency point of a frequency-domain sub-band is required to be acquired and a frequency point of the frequency-domain sub-band overlaps a frequency point of an adjacent frequency-domain sub-band of the frequency-domain sub-band, the separation matrix of the frequency point data corresponding to the overlapping frequency point may be acquired directly based on the adjacent frequency-domain sub-band of the frequency-domain sub-band and is not required to be reacquired.

In some other embodiments, the frequencies of any two adjacent frequency-domain sub-bands may not overlap with each other. In such a manner, in the embodiments of the present disclosure, the total amount of the frequency point data of each frequency-domain sub-band may be equal to the total amount of the frequency point data corresponding to the frequency points of the whole band, so that inaccurate calculation caused by omission of some frequency points for calculation of the weighting coefficient of the frequency point data of each frequency-domain sub-band may also be reduced to improve the accuracy of the weighting coefficient. In addition, the non-overlapping frequency point data may be used during calculation of the weighting coefficient of the adjacent frequency-domain sub-band, so that the calculation of the weighting coefficient may further be simplified.

In some embodiments, the operation that the audio signals of the at least two sound sources are obtained based on the separation matrices and the original noise signals may include that the mth frame of original noise signal corresponding to data of a frequency point may be separated based on the first separation matrix to the Nth separation matrix to obtain audio signals of different sound sources in the mth frame of original noise signal corresponding to the data of the frequency point, m being a positive integer smaller than M and M being the number of frames of the original noise signals. Further, audio signals of the yth sound source in the mth frame of original noise signal corresponding to data of each frequency point are combined to obtain an mth frame of audio signal of the yth sound source, y being a positive integer smaller than or equal to Y and Y being the number of the at least two sound sources.

For example, there may be two microphones, i.e., microphone 1 and microphone 2 respectively, and there may be two sound sources, i.e., sound source 1 and sound source 2 respectively. Both the microphone 1 and the microphone 2 may acquire three frames of original noise signals. In the first frame, corresponding separation matrices may be calculated for first frequency point data to Nth frequency point data respectively. For example, the separation matrix of the first frequency point data may be a first separation matrix, the separation matrix of the second frequency point data may be a second separation matrix, and by parity of reasoning, the separation matrix of the Nth frequency point data may be an Nth separation matrix. Then, an audio signal corresponding to the first frequency point data may be acquired based on a noise signal corresponding to the first frequency point data and the first separation matrix; an audio signal of the second frequency point data may be obtained based on a noise signal corresponding to the second frequency point data and the second separation matrix, and so forth, an audio signal of the Nth frequency point data may be obtained based on a noise signal corresponding to the Nth frequency point data and the Nth separation matrix. The audio signal of the first frequency point data, the audio signal of the second frequency point data and the audio signal of the third frequency point data may be combined to obtain first frames of audio signals of the microphone 1 and the microphone 2.

It can be understood that other frames of audio signals may also be acquired based on a method similar to that in the above example and elaborations are omitted herein.

In the embodiments, the audio signal of data of each frequency point in each frame may be obtained for the noise signal and separation matrix corresponding to data of each frequency point of the frame, and then the audio signals of data of each frequency point in the frame may be combined to obtain the audio signal of the frame. Therefore, in the embodiments of the present disclosure, after the audio signal of the frequency point data is obtained, time-domain conversion may further be performed on the audio signal to obtain the audio signal of each sound source in the time domain.

For example, time-domain transform may be performed on the frequency-domain signal based on Inverse Fast Fourier Transform (IFFT). Or, the frequency-domain signal may be converted into a time-domain signal based on Inverse Short-Time Fourier Transform (ISTFT). Or, time-domain transform may also be performed on the frequency-domain signal based on other Fourier transform.

In some embodiments, the method may further include that: the first frame of audio signal to the Mth frame of audio signal of the yth sound source are combined according to a time sequence to obtain the audio signal of the yth sound source in the M frames of original noise signals.

For example, there may be two microphones, i.e., microphone 1 and microphone 2 respectively, and there may be two sound sources, i.e., sound source 1 and sound source 2 respectively; and both the microphone 1 and the microphone 2 may acquire three frames of original noise signals according to a time sequence respectively, the three frames being a first frame, a second frame and a third frame. First, second and third frames of audio signals of the sound source 1 may be obtained by calculation respectively, and thus the audio signal of the sound source 1 may be obtained by combining the first, second and third frames of audio signals of the sound source 1 according to the time sequence. First, second and third frames of audio signals of the sound source 2 may be obtained respectively, and thus the audio signal of the sound source 1 may be obtained by combining the first, second and third frames of audio signals of the sound source 2 according to the time sequence.

In the embodiments, the audio signals of each audio frame of each sound source may be combined, thereby obtaining the complete audio signal of each sound source.

Figure 2:
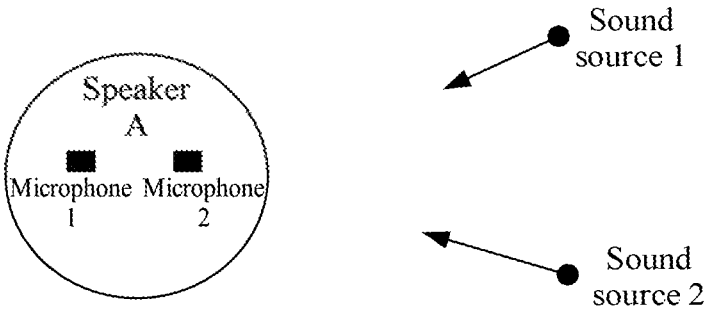
FIG. 2 is a block diagram of an application scenario of a method for processing an audio signal according to an exemplary embodiment.

For helping the abovementioned embodiments of the present disclosure to be understood, descriptions are made herein with the following example. As shown in FIG. 2, an application scenario of a method for processing an audio signal is disclosed. A terminal may include speaker A, the speaker A may include two microphones, i.e., microphone 1 and microphone 2 respectively, and there may be two sound sources, i.e., sound source 1 and sound source 2 respectively. Signals sent by the sound source 1 and the sound source 2 may be acquired by the microphone 1 and the microphone 2. The signals of the two sound sources may be aliased in each microphone.

Figure 3:
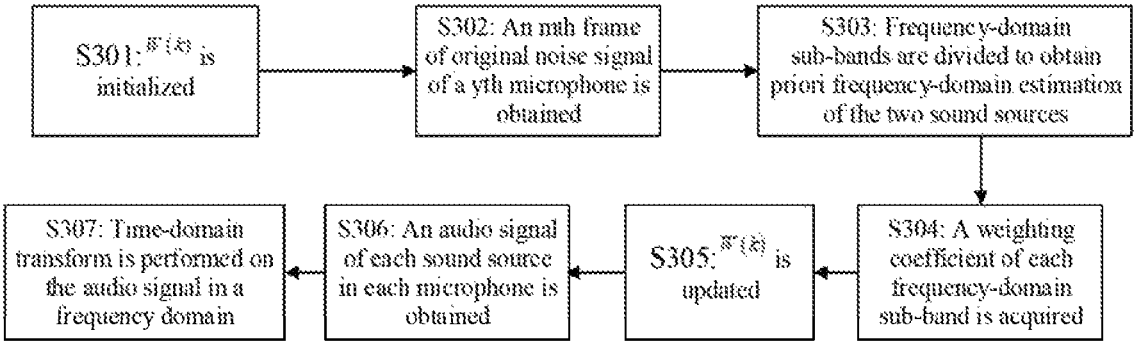
FIG. 3 is a flowchart showing a method for processing an audio signal according to an exemplary embodiment.

FIG. 3 is a flowchart showing a method for processing an audio signal according to an exemplary embodiment. In the method for processing an audio signal, as shown in FIG. 2, sound sources may include sound source 1 and sound source 2, and microphones may include microphone 1 and microphone 2. Based on the method for processing an audio signal, the sound source 1 and the sound source 2 may be recovered from signals of the microphone 1 and the microphone 2. As shown in FIG. 3, the method may include the following operations.

If a system frame length is Nfft, frequency point K=Nfft/2+1.

In S301, W(k) is initialized. Specifically, a separation matrix of each frequency-domain estimated signal may be initialized.

$$W(k) = [w_1(k), w_2(k)]^H = \begin{bmatrix} 1 & 0 \\ 0 & 1 \end{bmatrix},$$

where $$\begin{bmatrix} 1 & 0 \\ 0 & 1 \end{bmatrix}$$

is an identity matrix, k is the frequency-domain estimated signal, and k=1, L, K.

In S302, an mth frame of original noise signal of the yth microphone is obtained. Specifically, $x_y^m(k)$ is windowed to perform STFT based on Nfft points to obtain a frequency-domain signal: $X_y(k,m)=STFT(x_y^m(m'))$, where m' is the number of points selected for Fourier transform, STFT is short-time Fourier transform, and $x_y^n(m)$ is an mth frame of time-domain signal of the yth microphone. Herein, the time-domain signal is an original noise signal.

Herein, when y=1, the microphone 1 is represented, and when y=2, the microphone 2 is represented.

Then, an observation signal of $X_y$ (k,m) is $X(k,m)=[X_1(k,m),X_2(k,m)]^T$, where $X_1(k,m)$ and $X_2(k,m)$ are the original noise signals of the sound source 1 and the sound source 2 in a frequency domain respectively, and $[X_1(k,m),X_2(k,m)]^T$ is a transposed matrix.

In S303, frequency-domain sub-bands are divided to obtain priori frequency-domain estimation of the two sound sources. Specifically, it may be set that the priori frequency-domain estimation of the signals of the two sound sources is $Y(k,m)=[Y_1(k,m),Y_2(k,m)]^T$, where $Y_1(k,m),Y_2(k,m)$ are estimated values of the sound source 1 and the sound source 2 at a frequency-domain estimated signal (k,m) respectively.

An observation matrix X(k,m) may be separated through the separation matrix W(k) to obtain: Y(k,m)=W(k)'X(k,m), where W'(k) is a separation matrix (i.e., an alternative matrix) obtained by last iteration.

Then, a priori frequency-domain estimation of the yth sound source in the mth frame may be: $\overline{Y}_y(n)=[Y_y(1,m),L\ Y_y(K,m)]^T$. Specifically, the whole band may be divided into N frequency-domain sub-bands.

A frequency-domain estimated signal of the nth frequency-domain sub-band may be acquired to be $\overline{Y}_y^n(m)=[Y_y(l_n,m), \ldots Y_y(h_n,m)]^T$, where n=1, L, N, $l_n$ and $h_n$ represent a first frequency point and last frequency point of the nth frequency-domain sub-band, $l_n<h_{n-1}$, and n=2, L, N. Herein, for ensuring partial frequency overlapping between adjacent frequency-domain sub-bands, $N_n=h_n-l_n+1$ represents the number of frequency points of the nth frequency-domain sub-band.

In S304, a weighting coefficient of each frequency-domain sub-band is acquired. Specifically, the weighting coefficient of the nth frequency-domain sub-band may be calculated to be:

$$\phi_y(k, m) = \frac{1}{\sqrt{\sum_{k=l_n}^{h_n} |Y_p(k, m)|^2}},$$

where y=1, 2.

The weighting coefficient of the nth frequency-domain sub-band of the microphone 1 and the microphone 2 may be obtained to be: $\phi(k,m)=[\phi_1(k,m), \phi_2(k,m)]^T$.

In S305, W(k) is updated.

The separation matrix of the point k may be obtained based on the weighting coefficient of each frequency-domain sub-band and the frequency-domain estimated signals of the point k in the first to mth frames:

$$W_x(k) = W_{x-1}(k) + \eta g\left\{I - \frac{1}{M}\sum_{m-1}^{M}[\phi_n(k, m)gY(k, m)]Y^H(k, m)\right\}W_{x-1}(k),$$

where $W_{x-1}(k)$ is the alternative matrix during last iteration, $W_x(k)$ is the alternative matrix acquired by present iteration, and $\eta$ is an updating step length.

In an embodiment, $\eta$ may be [0.005, 0.1].

Herein, if $|1-tr\{abs(W_x(k)W_{x-1}^H(k))\}/N|\leq\xi$, it may be indicated that the obtained $W_{x-1}(k)$ has met a convergence condition. If it is determined that $W_{x-1}(k)$ meets the convergence condition, W(k) may be updated to ensure $W(k)=W_x(k)$ for the separation matrix of the point k.

In an embodiment, $\xi$ may be a value smaller than or equal to $(1/10^6)$.

Herein, if the weighting coefficient of the frequency-domain sub-band is the weighting coefficient of the nth frequency-domain sub-band, the point k may be in the nth frequency-domain sub-band.

In the embodiment, gradient iteration may be performed according to a sequence from high to low frequencies. Therefore, the separation matrix of each frequency of each frequency-domain sub-band may be updated.

Exemplarily, a pseudo code for sequentially acquiring the separation matrix of each frequency-domain estimated signal may be provided below.

Converged[m][k] may be set to indicate a converged state of the kth frequency point of the nth frequency-domain sub-band, n=1, L, N, and k=1, L, K. In case of converged [m][k]=1, it may be indicated that the present frequency point has been converged, otherwise it is not converged.

For $c = N : 1$;

For $iter = 1 : MaxIter$;

For $k = l_n : h_n$;

$Y(k, m) = W(k)X(k, m)$;

$$\phi_y(k, m) = \frac{1}{\sqrt{\sum_{k=l_n}^{h_n} |Y_p(k, m)|^2}}, \; y = 1, 2;$$

$\phi(k, m) = [\phi_1(k, m), \; \phi_2(k, m)]^T$;

END;

For $k = l_n : h_n$;

If(converged$[m][k] = 1$);

Continue;

END;

$W_x(k) =$ $$W_{x-1}(k) + \eta g\left\{I - \frac{1}{M}\sum_{m=1}^{M}[\phi_n(k, m)gY(k, m)]Y^H(k, m)\right\}W_{x-1}(k);$$

If$|1 - tr\{abs(W_x(k)W_{x-1}^H(k))\}/N| \leq \xi$;

converged$[m][k] = 1$;

END $W(k) = W_0(k)$.

END;

END;

END.

In the example, $\xi$ may be a threshold for judging convergence of W(k), and $\xi$ may be $(1/10^6)$.

In S306, an audio signal of each sound source in each microphone may be obtained. Specifically, W(k) may be obtained based on the updated separation matrix $Y_y(k,m)=W_y(k)X_y(k,m)$, where y=1, 2, $Y(k,m)=[Y_1(k,m), Y_2(k,m)]^T$, $W_y(k)=[W_1(k,m),W_2(k,m)]$ and $X_y(k,m)=[X_1(k,m),X_2(k,m)]^T$.

In S307, time-domain transform is performed on the audio signal in a frequency domain.

Time-domain transform may be performed on the audio signal in the frequency domain to obtain an audio signal in a time domain.

ISTFT and overlapping-addition may be performed on $\overline{Y}_y(n)=[Y_y(1,m), \ldots, Y_y(K,m)]^T$ to obtain an estimated third audio signal $s_y^m(m')=ISTFT(\overline{Y}_y(m))$ in the time domain respectively.

In the embodiments, the obtained separation matrices may be obtained based on the weighting coefficients determined for the frequency-domain estimated components corresponding to the frequency points of different frequency-domain sub-bands, which, compared with acquisition of the separation matrices based on that all frequency-domain estimated signals of the whole band have the same dependence in the related arts, may achieve higher separation performance. Therefore, the separation performance may be improved by obtaining the audio signals from the two sound sources based on the original noise signals and the separation matrices obtained according to the embodiments of the present disclosure, and some easy-to-damage audio signals of the frequency-domain estimated signals may be recovered to further improve voice separation quality.

In addition, the separation matrices of the frequency-domain estimated signals may be sequentially acquired based on the frequencies corresponding to the frequency-domain sub-bands, so that the condition that the separation matrices of the frequency-domain estimated signals corresponding to some frequency points are omitted may be greatly reduced, loss of the audio signal of each sound source at each frequency point may be reduced, and quality of the acquired audio signals of the sound sources may be improved. Moreover, the frequencies of two adjacent frequency-domain sub-bands partially may overlap, so that dependence of each frequency-domain estimated signal in the adjacent frequency-domain sub-bands may be strengthened based on a principle that the dependence of the frequency points that are relatively close to each other in the band may be stronger, and a more accurate weighting coefficient may be obtained.

Compared with the situation that signals of sound sources are separated by use of a multi-microphone beamforming technology, the method for processing an audio signal provided in the embodiments of the present disclosure has the advantage that positions of these microphones are not needed to be considered, so that the audio signals of the sounds produced by the sound sources may be separated more accurately. In addition, when the method for processing an audio signal is applied to a terminal device with two microphones, compared with the related arts that voice quality is improved by use of a beamforming technology based on at least more than three microphones, the method additionally has the advantages that the number of the microphones is greatly reduced, and hardware cost of the terminal is reduced.

Figure 4:
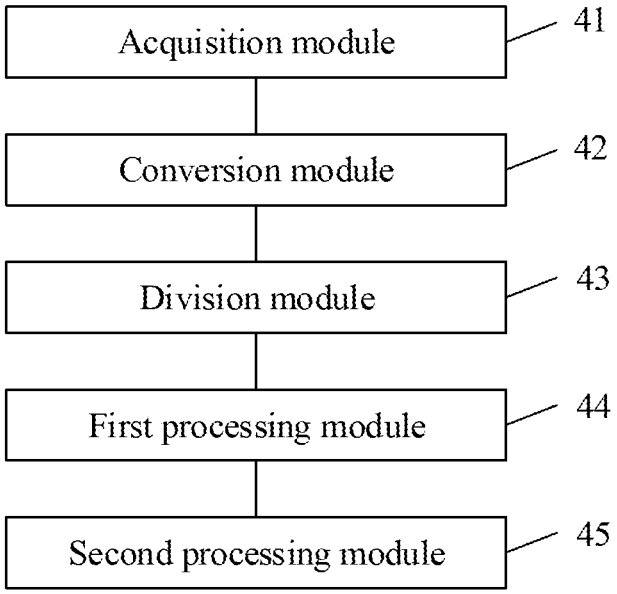
FIG. 4 is a schematic diagram illustrating a device for processing an audio signal according to an exemplary embodiment.

FIG. 4 is a block diagram of a device for processing an audio signal according to an exemplary embodiment. Referring to FIG. 4, the device can include an acquisition module 41, a conversion module 42, a division module 43, a first processing module 44, and a second processing module.

The acquisition module 41 is configured to acquire audio signals from at least two sound sources respectively through at least two microphones to obtain respective multiple frames of original noise signals of the at least two microphones in a time domain.

The conversion module 42 is configured to, for each frame in the time domain, acquire respective frequency-domain estimated signals of the at least two sound sources according to the respective original noise signals of the at least two microphones.

The division module 43 is configured to, for each of the at least two sound sources, divide the frequency-domain estimated signal into multiple frequency-domain estimated components in a frequency domain, each frequency-domain estimated component corresponding to a frequency-domain sub-band and including multiple frequency point data.

The first processing module 44 is configured to, in each frequency-domain sub-band, determine a weighting coefficient of each frequency point in the frequency-domain sub-band and update a separation matrix of each frequency point according to the weighting coefficient.

The second processing module 45 is configured to obtain the audio signals sent by the at least two sound sources respectively based on the updated separation matrices and the original noise signals.

In some embodiments, the first processing module 44 is configured to, for each sound source, perform gradient iteration on a weighting coefficient of a nth frequency-domain estimated component, the frequency-domain estimated signal and an (x−1)th alternative matrix to obtain an xth alternative matrix, a first alternative matrix being a known identity matrix, x being a positive integer greater than or equal to 2, n being a positive integer smaller than N and N being the number of the frequency-domain sub-bands. Further, when the xth alternative matrix meets an iteration stopping condition, the first processing module 44 can obtain the updated separation matrix of each frequency point in the nth frequency-domain estimated component based on the xth alternative matrix.

In some embodiments, the first processing module 44 may be further configured to obtain the weighting coefficient of the nth frequency-domain estimated component based on a quadratic sum of frequency point data corresponding to each frequency point in the nth frequency-domain estimated component.

In further embodiments, the second processing module 45 may be configured to separate a mth frame of original noise signal corresponding to data of a frequency point based on a first updated separation matrix to a Nth updated separation matrix to obtain audio signals of different sound sources from the mth frame of original noise signal corresponding to the data of the frequency point, m being a positive integer smaller than M and M being the number of frames of the original noise signals, and combine audio signals of a yth sound source in the mth frame of original noise signal corresponding to data of each frequency point to obtain an mth frame of audio signal of the yth sound source, y being a positive integer smaller than or equal to Y and Y being the number of the at least two sound sources.

In additional embodiments, the second processing module 45 may be further configured to combine a first frame of audio signal to a Mth frame of audio signal of the yth sound source according to a time sequence to obtain the audio signal of the yth sound source in the M frames of original noise signals.

Further, the first processing module 44 may be configured to perform gradient iteration according to a sequence from high to low frequencies of the frequency-domain sub-bands where the frequency-domain estimated signals are located. The frequencies of any two adjacent frequency-domain sub-bands partially overlap in the frequency domain.

With respect to the device in the above embodiments, the specific manners for performing operations for individual modules therein have been described in detail in the embodiment regarding the method, which will not be elaborated herein.

The embodiments of the present disclosure also provide a terminal having a processor and a memory configured to store instructions executable by the processor. The processor is configured to execute the executable instruction to implement the method for processing an audio signal according to any embodiment of the present disclosure.

The memory may include any type of storage medium. The storage medium may be a non-transitory computer storage medium and may keep information in a communication device when the communication device is powered down.

The processor may be connected with the memory through a bus and the like, and may be configured to read an executable program stored in the memory to implement, for example, at least one of the methods shown in FIG. 1 and FIG. 3.

The embodiments of the present disclosure also provide a computer-readable storage medium, which has an executable program stored thereon. The executable program may be executed by a processor to implement the method for processing an audio signal according to any embodiment of the present disclosure, for example, implementing at least one of the methods shown in FIG. 1 and FIG. 3.

With respect to the device in the above embodiments, the specific manners for performing operations for individual modules therein have been described in detail in the embodiment regarding the method, which will not be elaborated herein.

Figure 5:
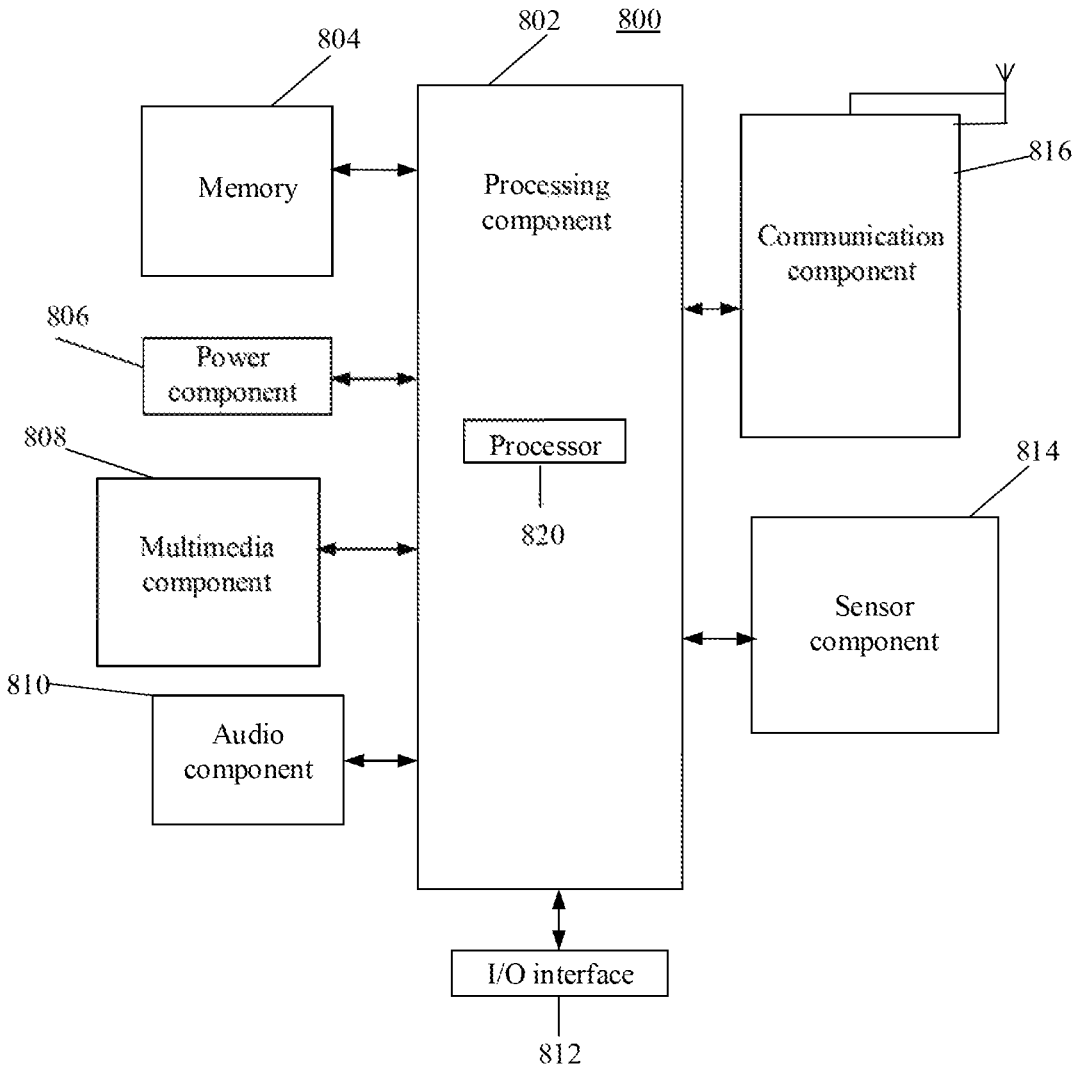
FIG. 5 is a block diagram of a terminal according to an exemplary embodiment.

FIG. 5 is a block diagram of a terminal 800 according to an exemplary embodiment. For example, the terminal 800 may be a mobile phone, a computer, a digital broadcast terminal, a messaging device, a gaming console, a tablet, a medical device, exercise equipment, a personal digital assistant, and the like.

Referring to FIG. 5, the terminal 800 may include one or more of the following components: a processing component 802, a memory 804, a power component 806, a multimedia component 808, an audio component 810, an Input/Output (I/O) interface 812, a sensor component 814, and a communication component 816.

The processing component 802 is typically configured to control overall operations of the terminal 800, such as the operations associated with display, telephone calls, data communications, camera operations, and recording operations. The processing component 802 may include one or more processors 820 to execute instructions to perform all or part of the operations in the abovementioned method. Moreover, the processing component 802 may include one or more modules which facilitate interaction between the processing component 802 and the other components. For instance, the processing component 802 may include a multimedia module to facilitate interaction between the multimedia component 808 and the processing component 802.

The memory 804 is configured to store various types of data to support the operation of the device 800. Examples of such data include instructions for any application programs or methods operated on the terminal 800, contact data, phonebook data, messages, pictures, video, etc. The memory 804 may be implemented by any type of volatile or non-volatile memory devices, or a combination thereof, such as a Static Random Access Memory (SRAM), an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, and a magnetic or optical disk.

The power component 806 is configured to provide power for various components of the terminal 800. The power component 806 may include a power management system, one or more power supplies, and other components associated with generation, management and distribution of power for the terminal 800.

The multimedia component 808 may include a screen providing an output interface between the terminal 800 and a user. In some embodiments, the screen may include a Liquid Crystal Display (LCD) and a Touch Panel (TP). If the screen includes the TP, the screen may be implemented as a touch screen to receive an input signal from the user. The TP includes one or more touch sensors to sense touches, swipes and gestures on the TP. The touch sensors may not only sense a boundary of a touch or swipe action but also detect a duration and pressure associated with the touch or swipe action. In some embodiments, the multimedia component 808 includes a front camera and/or a rear camera. The front camera and/or the rear camera may receive external multimedia data when the device 800 is in an operation mode, such as a photographing mode or a video mode. Each of the front camera and the rear camera may be a fixed optical lens system or have focusing and optical zooming capabilities.

The audio component 810 is configured to output and/or input an audio signal. For example, the audio component 810 includes a microphone, and the microphone is configured to receive an external audio signal when the terminal 800 is in the operation mode, such as a call mode, a recording mode and a voice recognition mode. The received audio signal may further be stored in the memory 804 or sent through the communication component 816. In some embodiments, the audio component 810 further includes a speaker configured to output the audio signal.

The I/O interface 812 may provide an interface between the processing component 802 and a peripheral interface module, and the peripheral interface module may be a keyboard, a click wheel, a button and the like. The button may include, but not limited to: a home button, a volume button, a starting button and a locking button.

The sensor component 814 may include one or more sensors configured to provide status assessment in various aspects for the terminal 800. For instance, the sensor component 814 may detect an on/off status of the device 800 and relative positioning of components, such as a display and small keyboard of the terminal 800, and the sensor component 814 may further detect a change in a position of the terminal 800 or a component of the terminal 800, presence or absence of contact between the user and the terminal 800, orientation or acceleration/deceleration of the terminal 800 and a change in temperature of the terminal 800. The sensor component 814 may include a proximity sensor configured to detect presence of an object nearby without any physical contact. The sensor component 814 may also include a light sensor, such as a Complementary Metal Oxide Semiconductor (CMOS) or Charge Coupled Device (CCD) image sensor, configured for use in an imaging application. In some embodiments, the sensor component 814 may also include an acceleration sensor, a gyroscope sensor, a magnetic sensor, a pressure sensor or a temperature sensor.

The communication component 816 is configured to facilitate wired or wireless communication between the terminal 800 and another device. The terminal 800 may access a communication-standard-based wireless network, such as a Wireless Fidelity (WiFi) network, a 2nd-Generation (2G) or 3rd-Generation (3G) network or a combination thereof. In an exemplary embodiment, the communication component 816 receives a broadcast signal or broadcast associated information from an external broadcast management system through a broadcast channel. In an exemplary embodiment, the communication component 816 further includes a Near Field Communication (NFC) module to facilitate short-range communication. For example, the NFC module may be implemented based on a Radio Frequency Identification (RHO) technology, an Infrared Data Association (IrDA) technology, an Ultra-Wide Band (UWB) technology, a Bluetooth (BT) technology and another technology.

In an exemplary embodiment, the terminal 800 may be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors or other electronic components, and is configured to execute the abovementioned method.

In an exemplary embodiment, there is also provided a non-transitory computer-readable storage medium including instructions, such as the memory 804 including instructions, and the instructions may be executed by the processor 820 of the terminal 800 to implement the abovementioned methods. For example, the non-transitory computer-readable storage medium may be a ROM, a Random Access Memory (RAM), a Compact Disc Read-Only Memory (CD-ROM), a magnetic tape, a floppy disc, an optical data storage device, and the like.

Other implementation solutions of the present disclosure will be apparent to those skilled in the art from consideration of the specification and practice of the present disclosure. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes may be made without departing from the scope thereof. It is intended that the scope of the present disclosure only be limited by the appended claims.

What is claimed is:

1. A method for processing an audio signal, comprising:

acquiring audio signals from at least two sound sources through at least two microphones to obtain multiple frames of original noise signals of the at least two microphones in a time domain;

for each frame in the time domain, acquiring frequency-domain estimated signals of the at least two sound sources according to the respective original noise signals of the at least two microphones;

for each of the at least two sound sources, dividing the frequency-domain estimated signal into multiple frequency-domain estimated components in a frequency domain, where each frequency-domain estimated component corresponds to one frequency-domain sub-band and includes multiple frequency point data;

in each frequency-domain sub-band, determining a weighting coefficient of each frequency point in the frequency-domain sub-band, and updating a separation matrix of each frequency point according to the weighting coefficient; and obtaining the audio signals sent by the at least two sound sources based on the updated separation matrices and the original noise signals, wherein frequencies of any two adjacent frequency-domain sub-bands partially overlap in the frequency domain.

2. The method of claim 1, wherein, in each frequency-domain sub-band, determining the weighting coefficient of each frequency point in the frequency-domain sub-band and updating the separation matrix of each frequency point according to the weighting coefficient further comprises:

for each sound source, performing gradient iteration on a weighting coefficient of an nth frequency-domain estimated component, the frequency-domain estimated signal and an (x−1)th alternative matrix to obtain an xth alternative matrix, where a first alternative matrix is a known identity matrix, x is a positive integer greater than or equal to 2, n is a positive integer smaller than N, and N is the number of the frequency-domain sub-bands; and when the xth alternative matrix meets an iteration stopping condition, obtaining the updated separation matrix of each frequency point in the nth frequency-domain estimated component based on the xth alternative matrix.

3. The method of claim 2, further comprising:

obtaining the weighting coefficient of the nth frequency-domain estimated component based on a quadratic sum of frequency point data corresponding to each frequency point in the nth frequency-domain estimated component.

4. The method of claim 2, wherein obtaining the audio signals sent by the at least two sound sources based on the updated separation matrices and the original noise signals further comprises:

separating an mth frame of original noise signal corresponding to data of a frequency point based on a first updated separation matrix to an Nth updated separation matrix to obtain audio signals of different sound sources from the mth frame of original noise signal corresponding to the data of the frequency point, where m is a positive integer smaller than M, and M is the number of frames of the original noise signals; and combining audio signals of a yth sound source in the mth frame of original noise signal corresponding to data of each frequency point to obtain an mth frame of audio signal of the yth sound source, wherein y is a positive integer smaller than or equal to Y, and Y is the number of the at least two sound sources.

5. The method of claim 4, further comprising:

combining a first frame of audio signal to an Mth frame of audio signal of the yth sound source according to a time sequence to obtain the audio signal of the yth sound source in the M frames of original noise signals.

6. The method of claim 2, wherein the gradient iteration is performed according to a sequence from high to low frequencies of the frequency-domain sub-bands where the frequency-domain estimated signals are located.

7. A terminal, comprising:

a processor; and a memory configured to store instructions executable by the processor, wherein the processor is configured to:

acquire audio signals from at least two sound sources through at least two microphones to obtain multiple frames of original noise signals of the at least two microphones in a time domain;

for each frame in the time domain, acquire respective frequency-domain estimated signals of the at least two sound sources according to the respective original noise signals of the at least two microphones;

for each of the at least two sound sources, divide the frequency-domain estimated signal into multiple frequency-domain estimated components in a frequency domain, where each frequency-domain estimated component corresponds to one frequency-domain sub-band and comprises multiple frequency point data;

in each frequency-domain sub-band, determine a weighting coefficient of each frequency point in the frequency-domain sub-band and update a separation matrix of each frequency point according to the weighting coefficient; and obtain the audio signals sent by the at least two sound sources based on the updated separation matrices and the original noise signals, wherein frequencies of any two adjacent frequency-domain sub-bands partially overlap in the frequency domain.

8. The device of claim 7, wherein the processor is further configured to:

for each sound source, perform gradient iteration on a weighting coefficient of an nth frequency-domain estimated component, the frequency-domain estimated signal and an (x−1)th alternative matrix to obtain an xth alternative matrix, where a first alternative matrix is a known identity matrix, x is a positive integer greater than or equal to 2, n is a positive integer smaller than N, and N is the number of the frequency-domain sub-bands, and when the xth alternative matrix meets an iteration stopping condition, obtain the updated separation matrix of each frequency point in the nth frequency-domain estimated component based on the xth alternative matrix.

9. The device of claim 8, wherein the processor is further configured to obtain the weighting coefficient of the nth frequency-domain estimated component based on a quadratic sum of frequency point data corresponding to each frequency point in the nth frequency-domain estimated component.

10. The device of claim 8, wherein the processor is further configured to:

separate an mth frame of original noise signal corresponding to data of a frequency point based on a first updated separation matrix to an Nth updated separation matrix to obtain audio signals of different sound sources from the mth frame of original noise signal corresponding to the data of the frequency point, where m is a positive integer smaller than M, and M is the number of frames of the original noise signals, and combine audio signals of a yth sound source in the mth frame of original noise signal corresponding to data of each frequency point to obtain an mth frame of audio signal of the yth sound source, where y is a positive integer smaller than or equal to Y, and Y is the number of the at least two sound sources.

11. The device of claim 10, wherein the processor is further configured to combine a first frame of audio signal to an Mth frame of audio signal of the yth sound source according to a time sequence to obtain the audio signal of the yth sound source in the M frames of original noise signals.

12. The device of claim 8, wherein the processor is further configured to perform the gradient iteration according to a sequence from high to low frequencies of the frequency-domain sub-bands where the frequency-domain estimated signals are located.

13. A non-transitory computer-readable storage medium, having an executable program stored thereon that, when executed by a processor, enables the processor to implement operations of:

acquiring audio signals from at least two sound sources through at least two microphones to obtain multiple frames of original noise signals of the at least two microphones in a time domain;

for each frame in the time domain, acquiring frequency-domain estimated signals of the at least two sound sources according to the respective original noise signals of the at least two microphones;

for each of the at least two sound sources, dividing the frequency-domain estimated signal into multiple frequency-domain estimated components in a frequency domain, wherein each frequency-domain estimated component corresponds to one frequency-domain sub-band and comprises multiple frequency point data;

in each frequency-domain sub-band, determining a weighting coefficient of each frequency point in the frequency-domain sub-band, and updating a separation matrix of each frequency point according to the weighting coefficient; and obtaining the audio signals sent by the at least two sound sources based on the updated separation matrices and the original noise signals, wherein frequencies of any two adjacent frequency-domain sub-bands partially overlap in the frequency domain.

14. The non-transitory computer-readable storage medium of claim 13, wherein the processor is further configured to:

for each sound source, perform gradient iteration on a weighting coefficient of an nth frequency-domain estimated component, the frequency-domain estimated signal and an (x−1)th alternative matrix to obtain an xth alternative matrix, where a first alternative matrix is a known identity matrix, x is a positive integer greater than or equal to 2, n is a positive integer smaller than N, and N is the number of the frequency-domain sub-bands, and when the xth alternative matrix meets an iteration stopping condition, obtain the updated separation matrix of each frequency point in the nth frequency-domain estimated component based on the xth alternative matrix.

15. The non-transitory computer-readable storage medium of claim 14, wherein the processor is further configured to obtain the weighting coefficient of the nth frequency-domain estimated component based on a quadratic sum of frequency point data corresponding to each frequency point in the nth frequency-domain estimated component.

16. The non-transitory computer-readable storage medium of claim 14, wherein the processor is further configured to:

separate an mth frame of original noise signal corresponding to data of a frequency point based on a first updated separation matrix to an Nth updated separation matrix to obtain audio signals of different sound sources from the mth frame of original noise signal corresponding to the data of the frequency point, where m is a positive integer smaller than M, and M is the number of frames of the original noise signals, and combine audio signals of a yth sound source in the mth frame of original noise signal corresponding to data of each frequency point to obtain an mth frame of audio signal of the yth sound source, where y is a positive integer smaller than or equal to Y, and Y is the number of the at least two sound sources.

17. The non-transitory computer-readable storage medium of claim 16, wherein the processor is further configured to combine a first frame of audio signal to an Mth frame of audio signal of the yth sound source according to a time sequence to obtain the audio signal of the yth sound source in the M frames of original noise signals.

18. The non-transitory computer-readable storage medium of claim 14, wherein the processor is further configured to perform the gradient iteration according to a sequence from high to low frequencies of the frequency-domain sub-bands where the frequency-domain estimated signals are located.

* * * * *